United States Patent [19]

Gavin et al.

[11] 4,215,888

[45] Aug. 5, 1980

[54] PICK-UP DEVICE

[76] Inventors: Douglas L. Gavin, 49 E. 12th St.; Edward E. Parmelee, 33 St. Marks Pl., both of New York, N.Y. 10003

[21] Appl. No.: 962,006

[22] Filed: Nov. 20, 1978

[51] Int. Cl.[2] ..... A47I 13/52

[52] U.S. Cl. ..... 294/1 B

[58] Field of Search ..... 294/1 R, 19 R, 55, 16, 294/1 B; 15/257.1, 104.8, 253.6; 119/1 R

[56] References Cited

U.S. PATENT DOCUMENTS

| | | | |
|---|---|---|---|
| 3,857,597 | 12/1974 | Young | 294/55 |
| 3,995,807 | 12/1976 | Dell'Anno | 294/55 |
| 4,017,015 | 4/1977 | Jefferson | 294/1 R |

*Primary Examiner*—James T. Marbert

*Attorney, Agent, or Firm*—Darby & Darby

[57] ABSTRACT

A pick-up device is disclosed which may consist of a rigid hollow sleeve having a bottom wall, a top wall and a pair of sidewalls. The sleeve is open at least at one end to receive a corresponding tray having a base wall and at least one, although preferably three generally upstanding sidewalls defining a substantially continuous rim. The tray is slidably arranged within the sleeve to be movable back and forth between an extended and retracted position. The tray, in its extended position, is placed rim-down over an object or material to be removed so as to cover the object. The tray is then pushed or retracted into the sleeve and thereby scrapes or carries the object into the sleeve for subsequent disposal. The sidewalls of the tray and sleeve may be foldable, if desired, to satisfy requirements for various uses to which the device may be put.

1 Claim, 12 Drawing Figures

PICK-UP DEVICE

BACKGROUND OF THE INVENTION

The present invention relates to pick-up devices and in particular to an implement and/or method to be used in the removal of an object or material from a surface. In one form, the invention may be utilized especially as an aid in the removal of pet waste material, and while this form of the device is specifically described below, it is to be understood that the invention is not be be limited to such use. For example, the invention may be put to related uses such as the removal of sand piles, garbage or other waste from city streets, or may even be used under water or in some cases, for measuring metered quantities of material.

Pet waste is now considered to be an environmental problem of major proportions. As a result, many communities have been enacting regulations requiring pet owners to dispose of solid waste material deposited by their pets on public streets and parks.

Accordingly, a variety of scoops, scrapers, pans and related receptacles or containers have been provided for effecting removal and subsequent disposal of solid pet waste. One of the more frequently employed varieties of such prior receptacles consists of a two-piece hinged or jaw-like waste enclosure having an elongated handle with which to manipulate the enclosure to pivot between open and closed positions in picking up waste material deposited on the ground. However, this type of receptacle is relatively expensive and somewhat awkward to carry around, thereby increasing the burden on the pet owner of the obligation to clean up after the pet.

Another known type of waste removal aid consists of a disposable pan into which pet waste is pushed or shoveled. The pan is formed from a folded blank into an open ended box having a flat shovel-like extension at the open end onto which the waste material can be pushed. Disposable pans of this type however, while convenient in many respects, have suffered from the disadvantage of requiring the pet owner to carry a separate shovel or pusher implement with which to scrape or push the waste material off of the street and into the pan.

These and other disadvantages of the previously known waste removal implements are obviated by the present invention which in its most basic form consists of a pusher or scraper tray having at least one upstanding sidewall. The tray is slidably arranged within an open ended box-like surrounding sleeve so as to be movable between an open or extended position for inverted placement over the waste material and a retracted or closed position for retaining or sealing the material within the sleeve. The waste material is scraped off of the street or other surface and into the sleeve during movement of the tray from its extended to its closed position within the sleeve.

For pet waste removal, the device may be made from lightweight paperboard or similar materials, including plastic, and can be provided to the consumer in blank form ready for assembly by making a series of simple folds. In at least one embodiment, glue, tape or other binding materials are not required for assembly and, in any event, the user need not carry handles and separate pusher or shover implements which may be awkward to carry both before and after use or difficult to conceal or to package for disposal. Moreover, in accordance with one aspect of the invention, the assembled device may be collapsed or folded into a substantially flat package to facilitate ease of handling or carriage prior to use. The present device is simple, convenient and sanitary and offers substantial advantages over the waste removal aids previously available.

Where other uses are contemplated such as in large-scale pick of objects or material or even under water, the device may be made of steel, aluminum or other suitably rigid and durable materials.

BRIEF DESCRIPTION OF THE DRAWINGS

For a further understanding of the present invention, reference may be had to the accompanying drawings, in which.

BRIEF DESCRIPTION OF THE PREFERRED EMBODIMENTS

The pick-up device of the present invention consists essentially of a two-piece portable implement including a hollow box-like container housing or sleeve open at least at one end. A scraper tray is slidably inserted into the sleeve through its open end to move between an open or extended position, for covering the material or object to be removed, and a closed position for retaining the material within the sleeve. The material is pushed into the sleeve upon movement of the tray from its open to its closed position.

Figure 5:
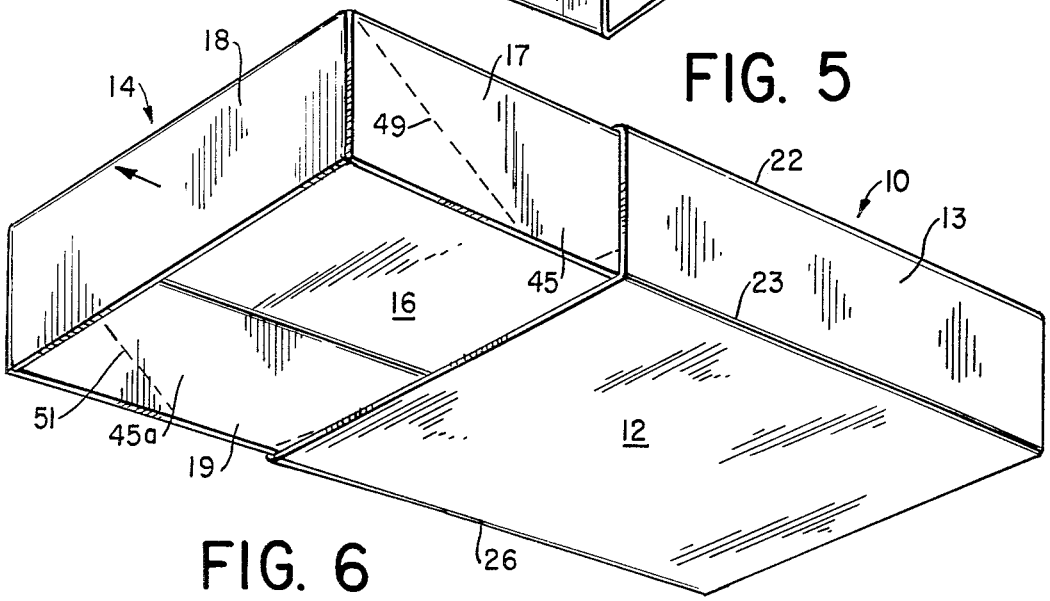
FIG. 5 is a view in perspective of one embodiment of an assembled pick-up device of the present invention substantially in a form satisfactory for any of the uses referred to above.
Figure 11:
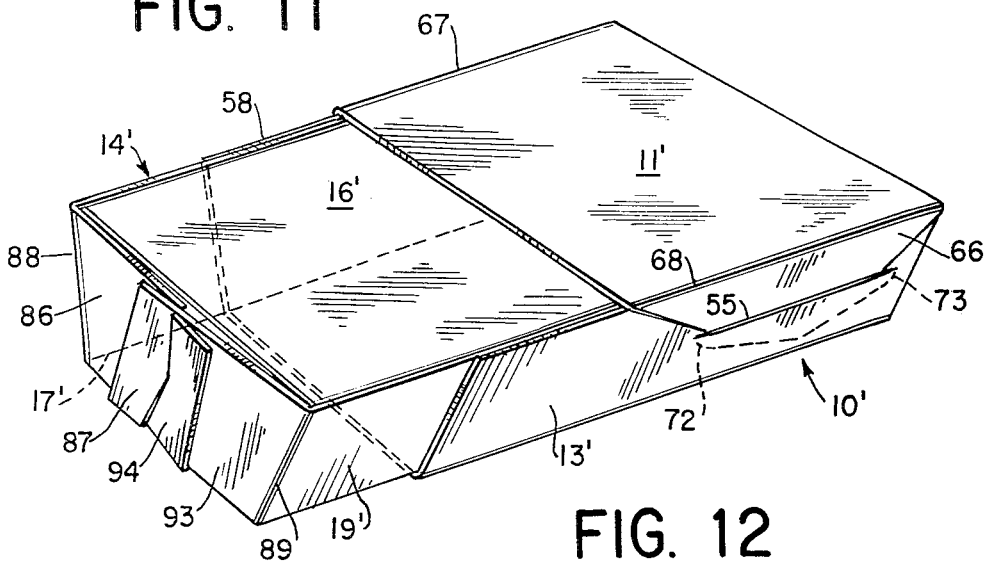
FIGS. 11 and 12 are views in perspective of the assembled pick-up device in accordance with the embodiments of FIGS. 9 and 10.

In each of the embodiments illustrated respectively in FIGS. 5 and 11, the housing or sleeve 10 and 10' consists of opposed pairs of similar top and bottom walls 11, 12 and 11' and 12' separated and supported by generally upstanding side walls, one of which is indicated by reference numerals 13 and 13' respectively, for each embodiment.

The insertable scraper trays 14 and 14' each conform in cross-section to the respective openings in the sleeves 11 and 11' so as to fit snugly therein and yet be easily slidable back and forth between the open position outside of the sleeve and the closed position within the sleeve. In both embodiments, the tray is formed with a generally flat substantially rectangular major panel 16 and 16' respectively, to serve as the bottom or base wall thereof. In each case, at least one, but preferably three peripheral edges of the base wall are joined to a corresponding upright side panel—for example, 17, 18, 19 (tray 14) and 17', 18' and 19' (tray 14') defining the rim of the tray. The tray is inserted into the sleeve such that the side panels extend outside of the sleeves when the tray is in its open position. The outermost panel defines a rigid scraper or pusher section with which to force material to be picked up into the sleeve, as described below.

There are however several basic distinctions between these embodiments. For example, in the embodiment of FIG. 5 the sleeve 10 is open at both ends while the tray is provided with four side panels so that both openings in the sleeve are closed or sealed when the tray is retracted within the sleeve. In the embodiment of FIG. 11, on the other hand, the sleeve 10' is closed at one end and open at the other end. Under these circumstances, the tray may be provided with no more than three side panels such that the scraper section alone serves to close the sleeve upon retraction of the tray therein.

In the embodiment of FIG. 5, moreover, the top wall 11 is approximately the same size as the bottom wall 12 so that the upstanding side walls 13 are generally vertical. In contrast, in the embodiment of FIG. 12, the top wall 11' is somewhat wider than the bottom wall 12' so that the side walls 13' are inclined to diverge outwardly from the bottom wall. Other modifications in the invention will become apparent from the more detailed description below.

Figure 1:
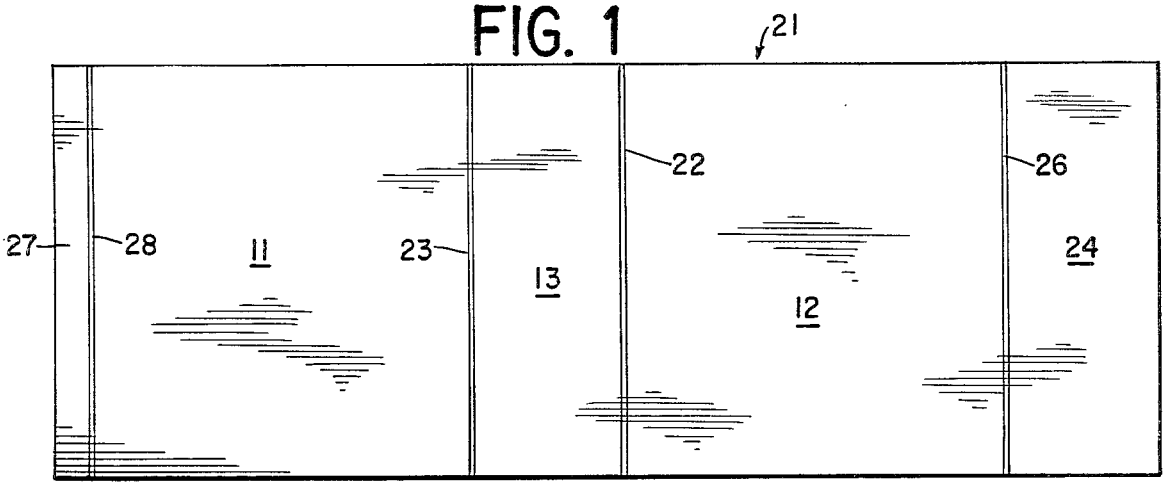
FIG. 1 is a plan view of the blank employed in forming the container sleeve of the present invention.

Referring now to FIG. 1, which relates to the formation of a pick-up device to be used, in particular, as a pet waste remover, the housing or sleeve 14 is formed from a blank 21 by a series of folding operations. The blank is made up of a group of sections or panels divided by a plurality of generally straight and parallel crease or fold lines. The two large panels define the top and bottom walls 11 and 12 respectively, and are separated by a panel defined by crease lines 22 and 23, which forms the side wall 13 upon conversion of the blank into the sleeve 14.

Panel 24 lies outwardly from the wall 12 to define the remaining side wall of the sleeve and is connected thereto along a crease line 26. A glue flap 27 is connected to the panel 11 along a crease line 28.

Figure 4:
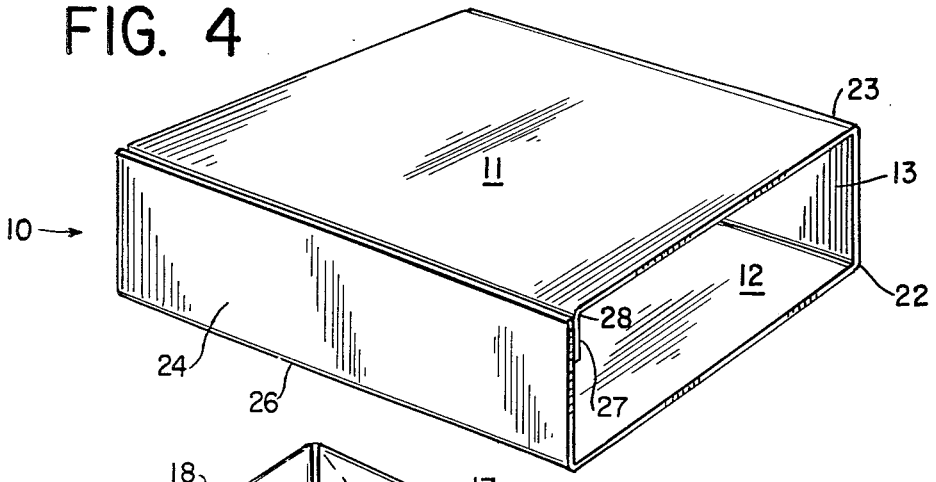
FIG. 4 is a view in perspective of the erected sleeve of the embodiment of FIG. 1.

The blank 21 is folded on its crease lines 22, 23, 26 and 28 to the position illustrated in FIG. 4 in which the top wall 11 overlies the bottom wall 12 and is spaced therefrom by the generally upright side walls 13 and 24. The glue flap 27 is affixed by a suitable adhesive along the interior surface of the panel 24. Thus erected, the blank 21 forms a hollow box-like structure defining the sleeve 10 which, in the present embodiment, is open at both ends.

Figure 2:
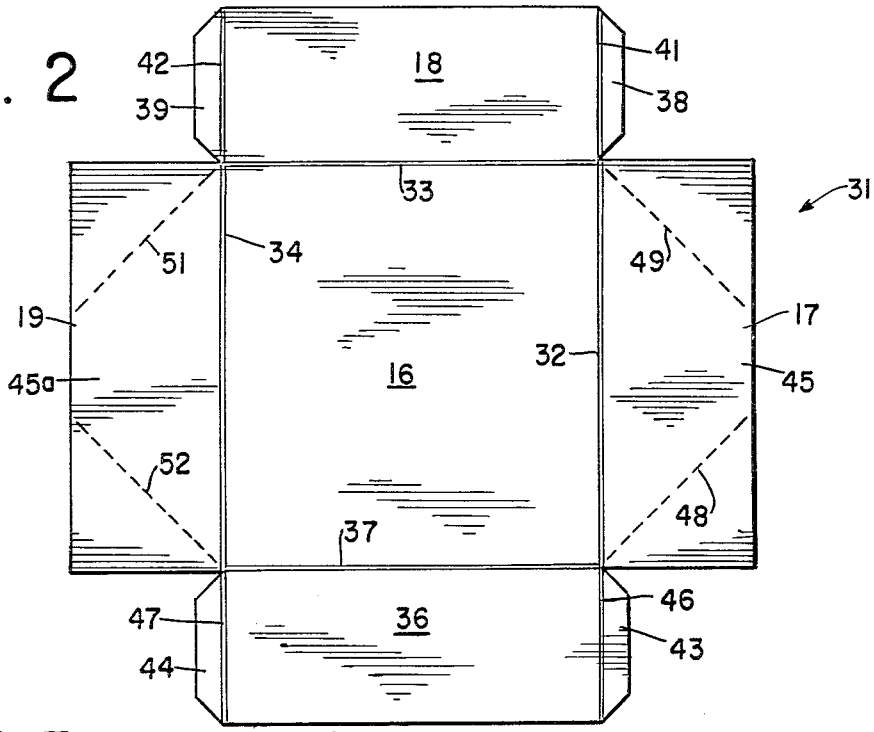
FIG. 2 is a plan view of the blank employed in forming the slidable scraper tray of the present invention.

Referring now to FIG. 2, the scraper tray 14 for use with the sleeve of FIG. 1, may similarly be formed by a series of folding operations from an appropriate blank 31. The blank 31 is generally symmetrical about a central panel 16 which defines the base wall of the tray once the tray has been formed and inserted into the sleeve ready for use.

In the present embodiment, the panel 16 is surrounded by a plurality of outwardly lying panels 17, 18, 19 and 36 which are connected thereto along corresponding crease lines 32, 33, 34 and 37, although in some circumstances only one such panel may be provided, as desired. These surrounding panels serve to define the four upright sidewalls of a tray erected from the blank 31. Glue flaps 38 and 39 are connected at opposite sides of the panel 18 along crease lines 41 and 42, respectively. Similarly, glue flaps 43 and 44 are connected at opposite sides of the panel 36 along crease lines 46 and 47. The panels 18 and 36 are generally of equal size and shape, as are the panels 17 and 19. If the panel 16 is of generally square configuration, all of the outwardly lying panels will be of the same size, although the invention is not to be limited to such a configuration.

In accordance with one aspect of the invention, opposite panels 17 and 19 of the tray may be traversed respectively by a pair of weakening lines 48, 49 (panel 17) and 51, 52 (panel 19). Weakening lines 48 and 49 begin at the crease line 32 at opposite corners of the panel 17 and traverse the panel in converging directions symmetrically dividing it into three sections, the center one of which is indicated by reference numeral 45. In the present embodiment, the interior angles formed between each of the lines 48 and 49 and the crease line 32 are substantially equal and are such that the center section 45 is shaped like a truncated triangle. Similarly, weakening lines 51 and 52 traverse the panel 19 in converging directions to divide it into three sections, including a center section **45*a* which mirrors the section 45 of the panel 17. The purpose of the weakening lines on the panels 17 and 19** will be described in detail below.

Figure 3:
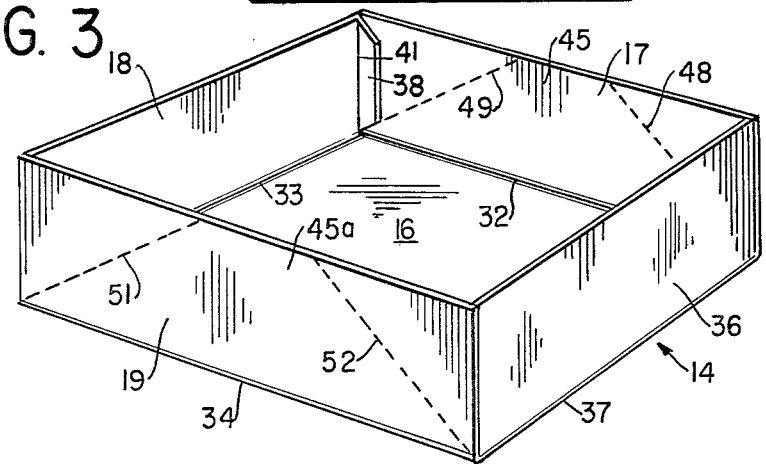
FIG. 3 is a view in perspective of the erected scraper tray of the embodiment of FIG. 2.

In erecting the blank 31 to form the scraper tray 14, the blank is folded along the crease lines 32, 33, 34 and 37 so that the panels 17, 18, 19 and 36 are brought into generally upright positions around the periphery of the panel 16, as shown in FIG. 3. Glue flaps 38 and 43 are adhered with suitable adhesive to the inner surface of the panel 17 while glue flaps 39 and 44 are similarly adhered to the inner surface of the panel 19. The tray is thereby retained in its erected configuration. As such, the tray may then be inserted into an open end of sleeve 10 to form the assembled waste remover, as described generally above in connection with FIG. 5. For reasons which will become apparent below, the tray is inserted into the sleeve with the panels 18 or 36 (without the weakening lines) facing outwardly from opposite ends of the sleeve. One of these panels thereby defines a relatively rigid scraper or pusher plate at one end of the tray and sleeve, while the other panel closes the opposite end of the sleeve.

Figure 6:
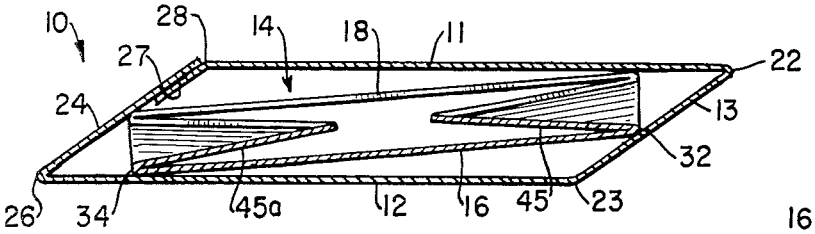
FIG. 6 is a transverse sectional view of the embodiment of FIG. 5, shown in partially collapsed position.

With reference to FIG. 6, it will be seen that the waste remover of the present embodiment may, in its assembled form, be folded or collapsed into a substantially flat package for ease of carrying prior to use. The side panels 17 and 19 of the tray 14 may be folded principally along their respective weakening lines inwardly toward each other and downwardly toward the tray bottom 16. The panel sections 45 and **45*a* are thus caused to lie against the tray bottom. As the sections 45 and 45*a* are folded inwardly, the relatively rigid end panels 18 and 36 are simultaneously drawn inwardly to bend along their corresponding crease lines 33 and 37. In this way, the tray 14 may be collapsed within the sleeve into the position illustrated in FIG. 6, where the end panels 18 and 36 overlie the panel 16**.

Simultaneously, the top wall 11 and bottom wall 12 of the sleeve 10 may be pushed laterally in opposite directions out of vertical alignment. This contrary relative movement causes the side walls 13 and 24 to pivot simultaneously in the same direction, as shown by way of example in FIG. 6, thereby to permit the sleeve to collapse as the walls 11 and 12 move toward each other to press the inwardly folded tray between them. The result is that the assembly may be folded into a substantially flat package to facilitate its being carried about by the pet owner prior to use.

Figure 8:
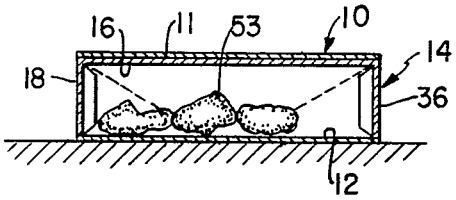
FIG. 8 is a sectional view of the embodiment of FIG. 5 in closed position with waste material trapped inside.
Figure 7:
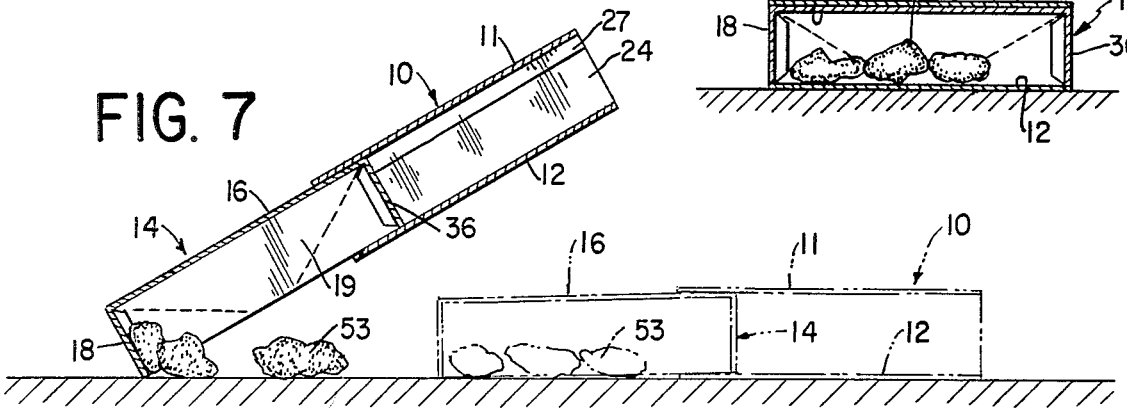
FIG. 7 is a sectional view of the embodiment of FIG. 5 showing the opened pick up device in two positions during use, for example, as a pet waste remover.

Operation of an assembled pet waste remover is illustrated in FIGS. 7 and 8. The device is used for removing a dog's or other pet's waste 53 lying, for example, in a street. To do so, the tray 14 is extended out of the sleeve to its open position and is placed over the waste material and against the street with the rims of its sidewalls down so as to contain the material therewithin. The tray is then moved inwardly to its closed position such that its relatively rigid end panel or scraper 18 serves to push the waste material off of the street and into the interior of the sleeve, as shown in FIG. 8. The waste remover and its contents can then be carried to the nearest disposal location.

Figure 9:
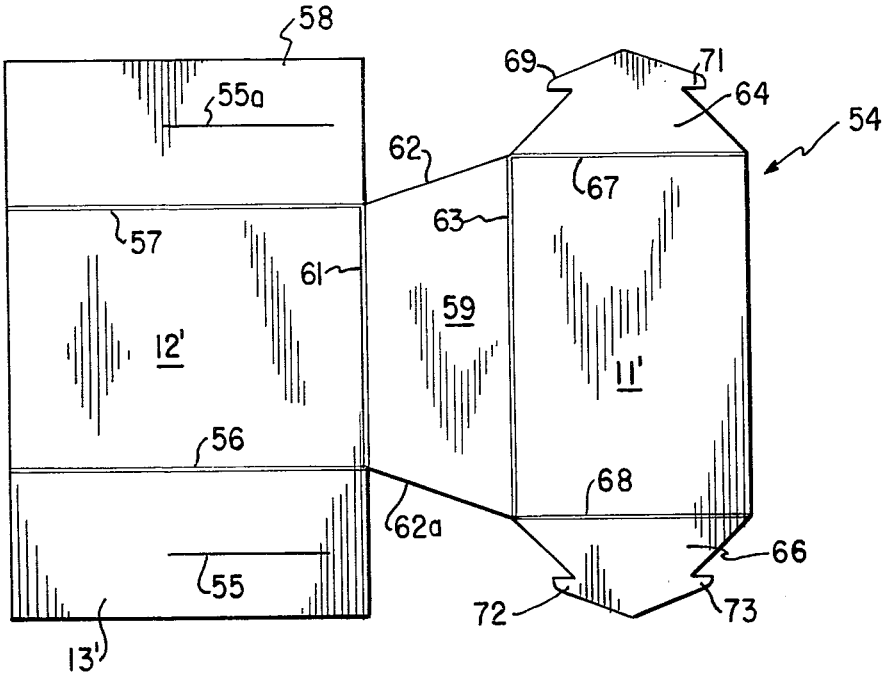
FIG. 9 is a plan view of the blank employed in forming an alternate embodiment of the container sleeve of the present invention.
Figure 10:
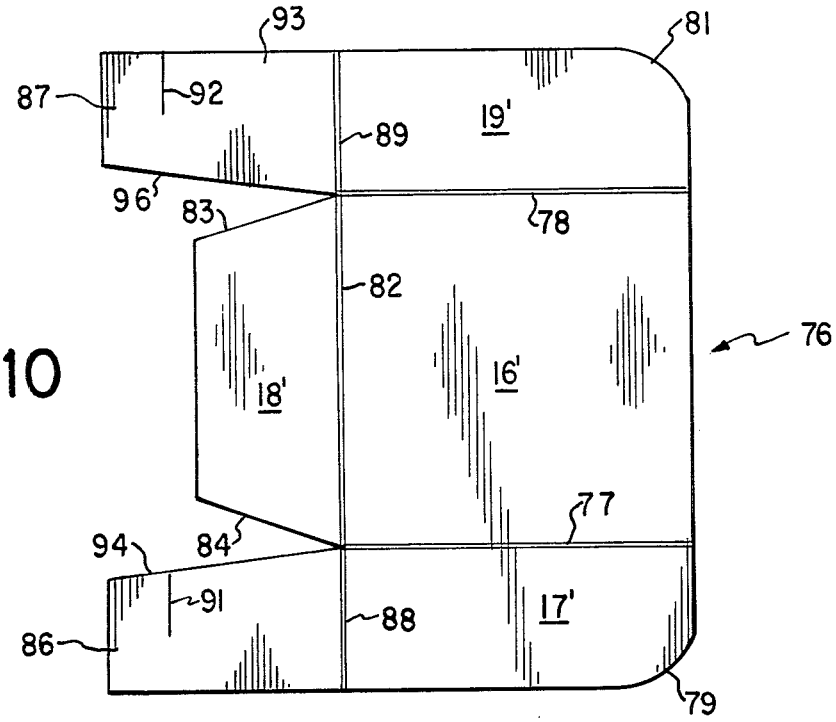
FIG. 10 is a plan view of the blank employed in forming an alternate embodiment of the scraper tray of the present invention.

FIGS. 9–11 illustrate an alternate embodiment of the present invention. This embodiment is likewise adapted for use as a pet waste removal aid. FIG. 9 depicts a blank 54 which is adapted to be converted into the sleeve 10' by a series of folding operations.

The blank 54 consists of a generally rectangular major panel or bottom wall 12' bordered on opposite sides by a pair of crease lines 56 and 57 by which it is connected to a pair of outwardly lying panels 13' and 58. The panels 13' and 58 are each provided with a longitudinal slot 55 and **55*a*** respectively, for a purpose to be described below.

Extending outwardly from a third side of the panel 12' is an end flap 59 which is connected to the panel 12' along a crease line 61. The flap 59 is generally trapezoidal, having opposite edges 62 and **62*a* which diverge outwardly from the crease line 61. It is connected to the top panel 11' along a crease line 63. The panel 11' is also rectangular, but its longitudinal axis is generally perpendicular to that of the panel 12'**.

Symmetrically disposed generally triangular retaining flaps 64 and 66 protrude outwardly from opposite edges of the panel 11' along corresponding crease lines 67 and 68. Each of the retaining flaps is provided near its apex with a pair of laterally protruding and oppositely extending tabs 69, 71 and 72, 73, respectively.

To erect the blank 54, the panels 13' and 58 are folded upwardly along crease lines 56 and 57 to form the side walls of the sleeve. The flap 59 is also folded upwardly along crease line 61 and the top wall 11' is folded inwardly along crease line 63 to a position overlying and generally parallel to the panel 12'. The retaining flaps 64 and 66 are then folded downwardly along respective crease lines 67 and 68 to overlie corresponding side wall panels 58 and 13'. The tabs 72 and 73 of the flap 66 are inserted through the slot 55 to lock behind the wall 13', as shown in FIG. 11. In like manner, the tabs 69 and 71 of the flap 64 are inserted through the slot 55 to lock behind the side wall 58'. In this way, the sleeve 10' is locked or retained in its erected shape without the need for a gluing procedure. Thus formed, the sleeve 10' defines a rigid and hollow box-like structure open at one end and bounded on three sides by the walls 11', 13' and 58. The side walls 13' and 58 are inclined inwardly from top to bottom to facilitate gripping and carrying of the sleeve during use.

The scraper tray 14' is formed from a flat blank 76 as shown in FIG. 10. The blank 76 consists of a generally rectangular central panel 16' defining the bottom of the tray and which is bounded along opposite edges by crease lines 77 and 78 to which a pair of symmetrically disposed outwardly lying wall panels 17' and 19' are respectively connected. Opposite corners 79 and 81 of the side walls 17' and 19' respectively may be slightly rounded to save material if necessary. An end flap 18' protrudes laterally outwardly from a third edge of the wall 16' and is connected thereto along a crease line 82. In the present embodiment, opposite edges 83 and 84 of the flap 18' are tapered inwardly by a predetermined amount to establish a corresponding slope in the side walls when the tray is erected, as described below.

A pair of reinforcing wings 86 and 87 protrude outwardly from the panels 17' and 19' respectively and are connected thereto along respective crease lines 88 and 89 which form colinear extensions of the crease line 82. The wings 86 and 87 are each provided with a transverse slot 91 and 92, respectively. Each of the slots extends approximately halfway across its wing, generally perpendicular to the longitudinal axis thereof. The slot 92 begins at the outer peripheral edge 93 of the wing 87, while the slot 91 begins at the inner peripheral edge 94 of the wing 96.

In the present embodiment, inwardly facing edges 94 and 96 of the wings 86 and 87 respectively are cut on an outwardly diverging bias from the crease line 82. The angles formed by opposing edges 84 and 94 and opposing edges 83 and 96 are preferably substantially equal.

Figure 12:
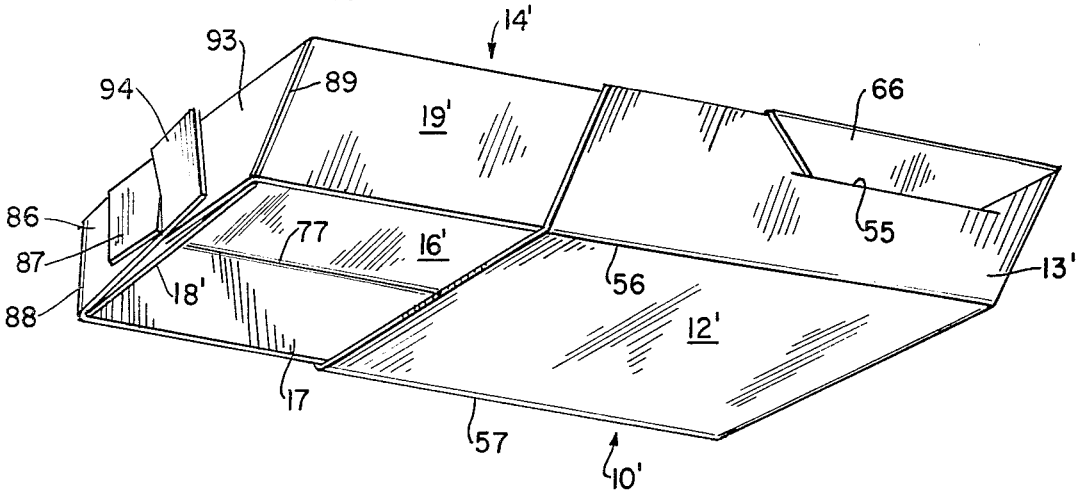

To form the erected tray 14' shown in FIGS. 11 and 12, the panels 17' and 19' and the end flap 18' of the blank 76 are folded upwardly along crease lines 77, 78 and 82 respectively to define adjoining end and side walls of the tray. The wings 86 and 87 are then folded inwardly toward each other along crease lines 88 and 89, respectively, and across the outer surface of the generally upright end flap 18'. The wings are connected together and locked in position by mutual intersection along the slots 91 and 92 to retain the tray in its erected shape. As a result of their engagement with the tapered edges 83 and 84 of the end flap 18', the sidewalls 17' and 19' are sloped inwardly from the lateral edges of the top wall 16'. Accordingly, upon proper insertion of the tray within the sleeve 10', the sloping sidewalls of the tray are substantially parallel to the adjacent sidewalls of the sleeve to facilitate a snug fit. Moreover, as a result of their bias cut, the edges 93 and 94 of the folded and interlocked wings 87 and 86 respectively are approximately flush with the plane of the outer surface of the top wall 16'.

The assembled waste remover may be utilized as described above in connection with the embodiment illustrated in FIGS. 7 and 8. In this arrangement however, the rigidity of the end flap or wall 18' is reinforced and retained by the overlapping reinforcing wings 86 and 87. Since, in the present embodiment, the top wall 11' of the sleeve is wider than the bottom wall 12', the upper edges along opposite sides of the sleeve may be easily and efficiently gripped during and after the waste removal procedure.

Various changes and modifications will occur to those skilled in the art. It is therefore intended that the scope of the present invention is not to be limited except as defined by the following claims.

What is claimed is:

1. A pick-up device comprising:

a hollow sleeve having a bottom wall, a pair of side walls and a top wall and being open at both of its ends; and a scraper tray insertable into said sleeve at the front end and movable back and forth between an open position extending outside the sleeve and a closed position within the sleeve, said tray having a base wall, a first upstanding side wall connected thereto and defining a continuous peripheral rim, said first side wall substantially closing the front end of said sleeve when said tray is in its closed position, and a second side wall adapted to close the other end of said sleeve when said tray is in its closed position, said tray being adapted to be placed in a rim-down position over an object when said tray is in its open position and thereafter closed to scrape and carry the object into the sleeve.

* * * * *